United States Patent [19]

Jacobsen

[11] Patent Number: 4,732,107

[45] Date of Patent: Mar. 22, 1988

[54] REMOVABLE PAGE MARKER

[76] Inventor: Edwin W. Jacobsen, 1928 S. 62nd St., Omaha, Nebr. 68106

[21] Appl. No.: 37,934

[22] Filed: Apr. 13, 1987

[51] Int. Cl.[4] ..... B42D 9/00; B42F 21/00

[52] U.S. Cl. ..... 116/237; 281/42

[58] Field of Search ..... 116/237, 236

[56] References Cited

U.S. PATENT DOCUMENTS

| | | | |
|---|---|---|---|
| 1,245,936 | 11/1917 | Loveland . | |
| 1,663,307 | 3/1928 | Jackson | 116/236 |
| 1,826,614 | 10/1931 | Graff et al. . | |
| 2,096,354 | 10/1937 | Bershad | 116/237 |
| 2,306,174 | 12/1942 | Mallory . | |
| 2,405,374 | 8/1946 | Singer, Jr. | 281/42 |
| 2,717,572 | 9/1955 | Kingman . | |
| 2,881,766 | 4/1959 | Tornsjo . | |
| 3,205,597 | 9/1965 | Stern . | |
| 3,404,435 | 10/1968 | Freundlich . | |
| 4,024,832 | 5/1977 | Machnikowski | 116/237 |
| 4,235,031 | 11/1980 | Aguilar | 281/42 |

FOREIGN PATENT DOCUMENTS

| | | | |
|---|---|---|---|
| 0344050 | 3/1931 | United Kingdom | 116/237 |

*Primary Examiner*—Daniel M. Yasich

*Attorney, Agent, or Firm*—Zarley, McKee, Thomte, Voorhees & Sease

[57] ABSTRACT

A removable page marker is formed from an elongated rectangular sheet of material folded back upon itself to form an upper and lower leg. The free end of the upper leg is bent back upon itself and extended between the upper and lower legs so as to yieldably bias against the lower leg. A fastener through the upper and lower legs forms a loop portion for holding an inscription sheet of printed matter.

10 Claims, 4 Drawing Figures

REMOVABLE PAGE MARKER

TECHNICAL FIELD

This invention relates generally to clamp devices, and more specifically to an improved page marker which is removable from a page.

BACKGROUND OF THE INVENTION

While there are many paper clips, clamps, and index tabs known in the prior art, they still suffer several drawbacks when used as a bookmark or the like. A common paper clip formed of bent plastic or metal wire, is typically formed in a single plane and attached to one or more sheets of paper by bending a tongue portion upwardly and inserting the paper between the tongue and the remainder of the clip. Such a clip relies on the resiliency of the plastic or metal to hold the clip to the paper. However, such a clip can easily wrinkle or damage the paper because of the force applied by the tongue on the paper in attempting to return to its original planar condition. Thus, the paper can become slightly folded between the tongue portion and the base portion, thereby damaging the page. Furthermore, the metal-type clips typically have a projecting end which can easily catch and rip the paper when the paper is fully inserted in the clip.

Index tabs utilized in the prior art typically have a pair of adhesive-backed legs which are permanently affixed to an index card or a file, the tab having a transparent portion which allows the insertion of an inscription sheet. While such tabs are easy to utilize in a filing system. they are impossible to use in a situation which requires a removable tab.

Other file tabs which merely clamp onto a piece of paper have the advantage of being removable from the sheet as required by the user. However, such tabs typically utilize a pair of resilient gripping legs which have their lower edges bent towards each other to form a tight grip. Such a tab grips the card firmly but it is very hard to install, adjust, or remove, and may damage the card or paper when removed. Typically, such tabs require that the gripping leg portions be manually separated before it can be attached to a card.

Still other types of clips utilize a clamp-type action which requires squeezing on a portion of the clip about a fulcrum, in order to open the clamp to fasten it on the page. Such clamp devices typically rely on two edges of a jaw in order to grip the paper, and can easily damage the paper.

It is therefore an object of the present invention to provide an improved removable page marker.

Another object of the present invention is to provide a page marker which may be used to turn single or multiple pages forward or backward.

Another object of the present invention is to provide a page marker which can be attached or removed in a single motion.

Still another object is to provide a marker which will not mark, mar, or damage the item it is attached to.

A further object of the present invention is to provide a page marker with a portion which will hold printed matter.

Yet another object is to provide a page marker which may also be used as an index tab.

These and other objects will be apparent to one skilled in this art.

SUMMARY OF THE INVENTION

The removable page marker of the present invention is formed from an elongated rectangular sheet of transparent plastic material by folding the material back upon itself to form generally parallel upper and lower legs. The free end of the upper leg is bent back upon itself and extended between the upper and lower leg. This bent end portion is thereby biased against the lower leg to form the clamping portion for holding the paper. A staple is fastened through the upper and lower legs and parallel to the fold, so that the marker will have its fold aligned with the edge of the page when installed thereon. A loop portion formed between the staple and fold will hold a removable inscription sheet with printed matter.

DESCRIPTION OF THE PREFERRED EMBODIMENT

Figure 1:
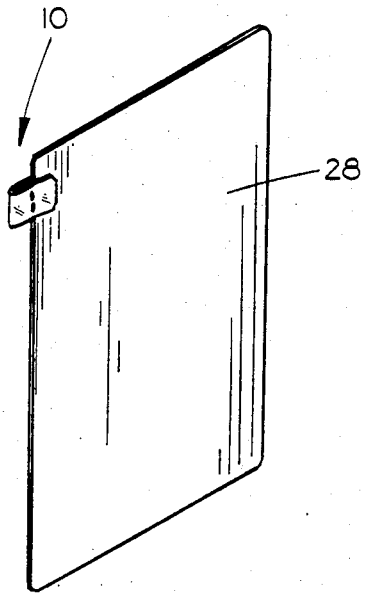
FIG. 1 is a perspective view of the invention attached to a sheet of paper.
Figure 2:
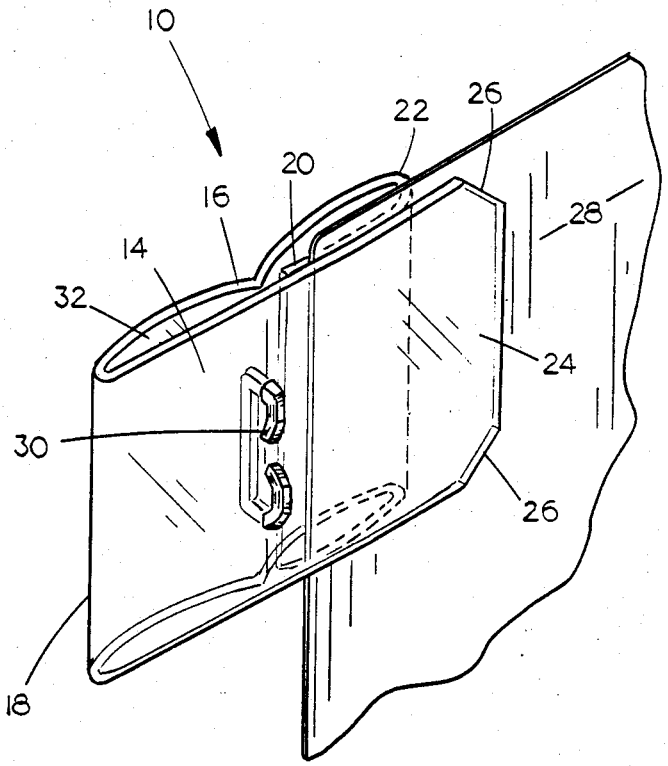
FIG. 2 is an enlarged perspective view of the invention.
Figure 3:
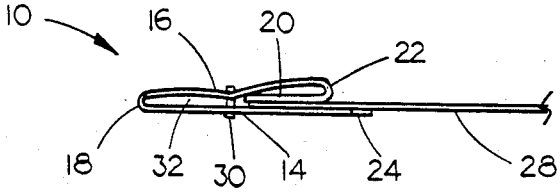
FIG. 3 is a side elevational view of the invention.
Figure 4:
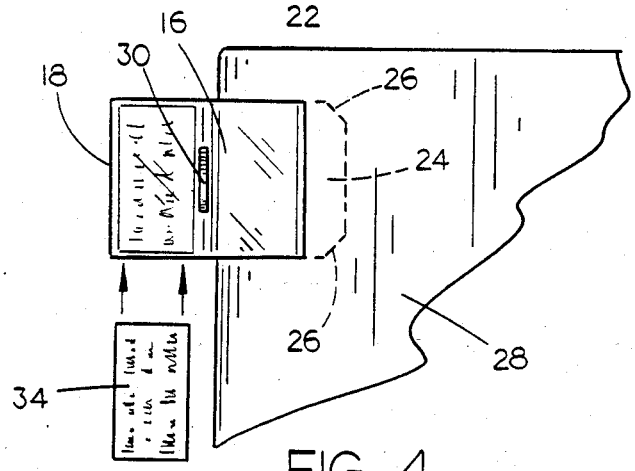
FIG. 4 is a top view of the invention.

Referring now to the drawings, in which identical or corresponding parts are identified by the same reference numeral, the removable page marker of this invention is identified generally at 10 and is formed from a single sheet of elongated rectangular transparent plastic material.

The plastic material sheet is folded back upon itself to form a lower and an upper leg 14 and 16, respectively, which extend generally parallel to one another from fold 18. The end portion 20 of upper leg 16 is bent back upon itself and extended between lower leg 14 and upper leg 16. The resilient bend 22 causes end portion 20 to be biased against lower leg 14.

As can be seen in the figures, lower leg 14 is longer than upper leg 16 so as to form a guide lip 24 which projects beyond the bend 22 of upper leg 16. Guide lip 24 has beveled corners 26 and serves to guide a page of paper 28, or any thin planar material, between lower leg 14 and end portion 20 which is biased against lower leg 14. The large area of frictional contact between end portion 20 and lower leg 14 forms a strong grip on paper 28 without causing any sharp edges to be forced against the paper 28. It can therefore be seen that it is virtually impossible to mark, wrinkle, or mar the paper 28 upon which the page marker 10 is fastened.

A fastener 30 is inserted through upper leg 16 and lower leg 14 so as to permanently hold end portion 20 biased against lower leg 14. Fastener 30 is shown in the drawings as a staple which is located immediately adjacent end portion 20 midway between fold 18 and bend 22. Fastener 30 is oriented so as to be parallel to fold 18 so that when page marker device 10 is installed on a page of paper 28, the fold 18 will be generally parallel to the edge of the paper 28.

End portion 20 extends immediately adjacent fastener 30 so that a paper 28 cannot be inserted past the edge of the end portion 20 and possibly be caught and damaged by the edge of end portion 20.

Fastener 30 serves to form a loop portion 32 between lower and upper legs 14 and 16 and between fastener 30 and fold 18. Loop portion 32 defines a tab which is easily grasped so as to turn a page of paper 28 upon which the page marker 10 is placed. Loop portion 32 can also receive an inscription sheet 34 upon which printing may be displayed. The clear material of page marker 10 makes any words written on inscription sheet 34 plainly visible from either side.

As seen in the figures, a sheet of paper 28 is easily inserted between lower leg 14 and end portion 20 of the page marker 10, and will cause bend 22 to be slightly compressed so as to increase the biasing pressure of end portion 20 against lower leg 14. It is important to note that end portion 20 has its lower surface area almost entirely in contact with the paper 28, such that the area which frictionally holds the paper within page marker 10 is quite large and without sharp edges. This large area of contact decreases the chances that the paper may be damaged or wrinkled in attaching or removing the page marker from a page.

It can therefore be seen that the removable page marker of the present invention accomplishes at least all of the above-stated objectives.

I claim:

1. A removable page marker, comprising a generally rectangular sheet material folded upon itself to form an upper and lower leg extending from the fold thereof and generally parallel to each other, said upper leg having a portion of its free end bent back upon itself and extended between said upper and lower leg so as to be yieldably biased against said lower leg, said page marker adapted to receive the edge of a sheet of paper between the bent back end portion of said upper leg and said lower leg.

2. The page marker of claim 1, wherein said biased bent back end portion of said upper leg extends from the bend approximately midway back towards the fold connecting said upper and lower legs.

3. The page marker of claim 1, further comprising fastener means connecting said upper and lower legs to form a loop portion between said fastener means and the fold connecting said upper and lower legs.

4. The page marker of claim 3, wherein said sheet material is transparent and further comprising an inscription sheet removably inserted within said loop portion.

5. The page marker of claim 1, wherein said lower leg is longer than said upper leg and is adapted to form a lip for guiding said sheet of paper between said lower and upper legs.

6. The page marker of claim 5, wherein said lip has beveled corners.

7. A removable page marker, comprising a generally rectangular sheet material folded upon itself to form an upper and lower leg extending from the fold thereof and generally parallel to each other, said upper leg having a portion of its free end bent back upon itself and extended between said upper and lower leg so as to be yieldably biased against said lower leg, said page marker adapted to receive the edge of a sheet of paper between the end portion of said upper leg and said lower leg.

further comprising fastener means connecting said upper and lower legs to form a loop portion between said fastener means and the fold connecting said upper and lower legs, and wherein said fastener means is located adjacent the free end of said biased end portion, and forms a stop means adapted to stop the insertion of said sheet of paper inserted between the legs of said page marker, whereby the loop portion of said marker will project outwardly from said sheet of paper when the marker is removably affixed thereto.

8. The page marker of claim 7, wherein said fastener means is adapted to align the marker on the planar material with the fold connecting said upper and lower legs parallel with the edge of said planar material.

9. The page marker of claim 8, wherein said fastener means is a staple fastened through said upper and lower legs, and parallel to the fold connecting said upper and lower legs.

10. A removable page marker, comprising: a generally rectangular sheet material folded back upon itself to form an upper and lower leg extending from the fold thereof and generally parallel to each other; said upper leg having a portion of its free end bent back and extended between said upper and lower legs; said bend adapted to yieldably bias the free end portion of said upper leg against said lower leg; fastener means connecting said upper and lower legs, and forming a loop portion between said fastener means, said fold, and said upper and lower legs; said lower leg being longer than said bent upper leg and adapted to form a lip for guiding a sheet of paper between said lower leg and the bent back end portion of said upper leg.

* * * * *